US008441199B2

(12) United States Patent
Santo et al.

(10) Patent No.: US 8,441,199 B2
(45) Date of Patent: May 14, 2013

(54) METHOD AND APPARATUS FOR AN INTELLIGENT LIGHT EMITTING DIODE DRIVER HAVING POWER FACTOR CORRECTION CAPABILITY

(75) Inventors: Hendrik Santo, San Jose, CA (US); Matthew D. Schindler, San Jose, CA (US); Dilip Sangam, Saratoga, CA (US); Tushar Dhayagude, Santa Clara, CA (US)

(73) Assignee: Atmel Corporation, San Jose, CA (US)

( * ) Notice: Subject to any disclaimer, the term of this patent is extended or adjusted under 35 U.S.C. 154(b) by 465 days.

(21) Appl. No.: 12/649,057

(22) Filed: Dec. 29, 2009

(65) Prior Publication Data

US 2010/0237786 A1 Sep. 23, 2010

Related U.S. Application Data

(63) Continuation-in-part of application No. 12/409,088, filed on Mar. 23, 2009, now Pat. No. 8,314,572.

(51) Int. Cl.
*H05B 41/36* (2006.01)

(52) U.S. Cl.
USPC ..... 315/224; 315/291; 315/307; 315/308

(58) Field of Classification Search ..... 315/185 R, 315/192, 200 R, 201, 205, 247, 250, 291, 315/294, 297, 299, 300, 302, 307, 308, 311, 315/312, 361
See application file for complete search history.

(56) References Cited

U.S. PATENT DOCUMENTS

| | | | |
|---|---|---|---|
| 5,315,214 | A | 5/1994 | Lesea |
| 5,722,040 | A | 2/1998 | Bjerede et al. |
| 5,744,986 | A | 4/1998 | Yamada et al. |
| 6,172,556 | B1 | 1/2001 | Prentice |

(Continued)

FOREIGN PATENT DOCUMENTS

| | | |
|---|---|---|
| CN | 201114961 | 9/2008 |
| JP | 2160283 A | 6/1990 |

(Continued)

OTHER PUBLICATIONS

International Search Report and Written Opinion for PCT Application No. PCT/US2010/061011 dated Jul. 6, 2011, 10 pages.

(Continued)

*Primary Examiner* — Douglas W Owens
*Assistant Examiner* — Jianzi Chen
(74) *Attorney, Agent, or Firm* — Fish & Richardson P.C.

(57) ABSTRACT

The present invention relates to circuits and methods for controlling one or more LED strings. The circuit comprises a programmable controller coupled to one or more detectors, wherein the one or more detectors are configured to detect one or more measurable parameters of one or more LEDs or LED drivers. The controller is configured to receive information from the one or more detectors related to the one or more measurable parameters and use that information to determine the desired drive voltage for the LED strings. The controller is associated with a power supply having power factor correction (PFC) capability. The controller provides the power supply with a control signal indicative of the desired drive voltage for one or more LED strings. The power supply also receives ac voltage and current waveforms as inputs and performs power factor correction and rectified waveforms related to the ac waveforms. The power supply generates the desired drive voltage based on the control signal.

20 Claims, 14 Drawing Sheets

U.S. PATENT DOCUMENTS

| | | | | |
|---|---|---|---|---|
| 6,593,709 | B2 | 7/2003 | Lee et al. | |
| 6,633,138 | B2 | 10/2003 | Shannon et al. | |
| 7,151,520 | B2 | 12/2006 | Maki | |
| 7,339,471 | B1 * | 3/2008 | Chan et al. | 340/541 |
| 8,044,919 | B2 | 10/2011 | Song et al. | |
| 8,072,444 | B2 | 12/2011 | Ikeda et al. | |
| 8,144,106 | B2 | 3/2012 | Kim | |
| 2002/0145041 | A1 * | 10/2002 | Muthu et al. | 235/454 |
| 2004/0105264 | A1 | 6/2004 | Spero | |
| 2005/0184708 | A1 | 8/2005 | Pipen et al. | |
| 2006/0022214 | A1 | 2/2006 | Morgan et al. | |
| 2006/0033536 | A1 | 2/2006 | Thelen et al. | |
| 2006/0214603 | A1 | 9/2006 | Oh et al. | |
| 2007/0040512 | A1 | 2/2007 | Jungwirth et al. | |
| 2007/0075958 | A1 | 4/2007 | Kim | |
| 2007/0091067 | A1 | 4/2007 | Elsheimer et al. | |
| 2007/0139319 | A1 | 6/2007 | Nishida et al. | |
| 2007/0273299 | A1 | 11/2007 | Miskin et al. | |
| 2007/0285133 | A1 | 12/2007 | Dickman et al. | |
| 2008/0042045 | A1 | 2/2008 | Miyazawa | |
| 2008/0084222 | A1 | 4/2008 | Yen | |
| 2008/0170012 | A1 | 7/2008 | S et al. | |
| 2008/0191631 | A1 | 8/2008 | Archenhold et al. | |
| 2008/0224629 | A1 | 9/2008 | Melanson | |
| 2008/0278097 | A1 | 11/2008 | Roberts et al. | |
| 2008/0309611 | A1 | 12/2008 | Yang | |
| 2009/0079362 | A1 | 3/2009 | Shteynberg et al. | |
| 2009/0128045 | A1 | 5/2009 | Szczeszynski et al. | |
| 2009/0179589 | A1 | 7/2009 | B hler et al. | |
| 2009/0184904 | A1 | 7/2009 | S. et al. | |
| 2009/0224736 | A1 | 9/2009 | Santo et al. | |
| 2009/0230882 | A1 | 9/2009 | Santo et al. | |
| 2009/0231247 | A1 | 9/2009 | Dhayagude et al. | |
| 2009/0267652 | A1 | 10/2009 | Santo et al. | |
| 2009/0315467 | A1 | 12/2009 | Schindler et al. | |
| 2010/0013395 | A1 | 1/2010 | Archibald et al. | |
| 2010/0188443 | A1 | 7/2010 | Lewis et al. | |

FOREIGN PATENT DOCUMENTS

| | | | |
|---|---|---|---|
| JP | 2003131620 | A | 5/2003 |
| JP | 2003288045 | A | 10/2003 |
| JP | 2004271759 | A | 9/2004 |
| JP | 2006185942 | A | 7/2006 |
| JP | 2007013530 | A | 1/2007 |
| WO | W02009016588 | A1 | 2/2009 |

OTHER PUBLICATIONS

International Search Report and Written Opinion for PCT Application No. PCT/US2009/053777 dated Nov. 5, 2009, 11 pages.
International Search Report and Written Opinion for PCT Application No. PCT/US2009/035334 dated Apr. 28, 2009, 10 pages.
International Search Report and Written Opinion for PCT Application No. PCT/US2009/048505 dated Jul. 31, 2009, 10 pages.
International Search Report and Written Opinion for PCT Application No. PCT/US2009/048769 dated Sep. 1, 2009, 10 pages.
International Preliminary Report on Patentability; BAI; Jul. 12, 2012; World Intellectual Property Organization (WIPO) (International Bureau of); 20275-0168WO1; 7 pages.
Office Action issued Sep. 18, 2012 in the Japanese Patent Application No. 2010-550742, 5pgs.

* cited by examiner

METHOD AND APPARATUS FOR AN INTELLIGENT LIGHT EMITTING DIODE DRIVER HAVING POWER FACTOR CORRECTION CAPABILITY

CLAIM OF PRIORITY UNDER 35 U.S.C. §120

The present Application for Patent is a continuation in part of patent application Ser. No. 12/409,088 filed Mar. 23, 2009, pending, and assigned to the assignee hereof and hereby expressly incorporated by reference herein.

REFERENCE TO CO-PENDING APPLICATIONS FOR PATENT

The present Application for Patent is related to the following U.S. Patent Applications:

U.S. patent application Ser. No. 12/046,280, filed Mar. 11, 2008, assigned to the assignee hereof, and expressly incorporated by reference herein; and U.S. patent application Ser. No. 12/111,114, filed Apr. 28, 2008, assigned to the assignee hereof, and expressly incorporated by reference herein.

BACKGROUND

1. Field

The present innovation relates to commercial electronic display systems such as television sets and computers. Specifically, the present innovation relates to techniques for enhanced and effective power distribution in commercial electronic display systems including the distribution of power to the light emitting diode (LED) strings for backlighting purposes.

2. Background

Backlights are used to illuminate liquid crystal displays ("LCDs"). LCDs with backlights are used in small displays for cell phones and personal digital assistants ("PDAs") as well as in large displays for computer monitors and televisions. Often, the light source for the backlight includes one or more cold cathode fluorescent lamps ("CCFLs"). The light source for the backlight can also be an incandescent light bulb, an electroluminescent panel ("ELP"), or one or more hot cathode fluorescent lamps ("HCFLs").

The display industry is enthusiastically pursuing the use of LEDs as the light source in the backlight technology because CCFLs have many shortcomings: they do not easily ignite in cold temperatures, they require adequate idle time to ignite, and they require delicate handling. Moreover, LEDs generally have a higher ratio of light generated to power consumed than the other backlight sources. Because of this, displays with LED backlights can consume less power than other displays. LED backlighting has traditionally been used in small, inexpensive LCD panels. However, LED backlighting is becoming more common in large displays such as those used for computers and televisions. In large displays, multiple LEDs are required to provide adequate backlight for the LCD display.

Circuits for driving multiple LEDs in large displays are typically arranged with LEDs distributed in multiple strings. FIG. 1 shows an exemplary flat panel display 10 with a backlighting system having three independent strings of LEDs 1, 2 and 3. The first string of LEDs 1 includes seven LEDs 4, 5, 6, 7, 8, 9 and 11 discretely scattered across the display 10 and connected in series. The first string 1 is controlled by the drive circuit or driver 12. The second string 2 is controlled by the drive circuit 13 and the third string 3 is controlled by the drive circuit 14. The LEDs of the LED strings 1, 2 and 3 can be connected in series by wires, traces or other connecting elements.

FIG. 2 shows another exemplary flat panel display 20 with a backlighting system having three independent strings of LEDs 21, 22 and 23. In this embodiment, the strings 21, 22 and 23 are arranged in a vertical fashion. The three strings 21, 22 and 23 are parallel to each other. The first string 21 includes seven LEDs 24, 25, 26, 27, 28, 29 and 31 connected in series, and is controlled by the drive circuit, or driver, 32. The second string 22 is controlled by the drive circuit 33 and the third string 23 is controlled by the drive circuit 34. One of ordinary skill in the art will appreciate that the LED strings can also be arranged in a horizontal fashion or in another configuration.

There are many parameters in an LED string that can be controlled to optimize the efficiency or/and other operating targets of an LED string and driver, including temperature, luminous intensity, color, current and voltage. For example, current is an important feature for displays because the current in the LEDs controls the brightness or luminous intensity of the LEDs. The intensity of an LED, or luminosity, is a function of the current flowing through the LED. FIG. 3 shows a representative plot of luminous intensity as a function of forward current for an LED. As the current in the LED increases, the intensity of the light produced by the LED increases. The current in the LEDs must be sufficiently high to meet the desired brightness requirement. The drive current of the LED string is a function of the drive voltage applied to the LED string. In conventional displays, the drive voltage for the LED strings is fixed at a higher level than necessary, often with a large margin referred to as headroom, to ensure the operation of the LED strings under the worst case physical, electrical and ambient conditions and to account for the variations in the LEDs made by various manufacturers. That results in wastage of power.

Commercial electronic display systems are generally plugged into wall outlets, which provide around 110 volts alternating current (VAC) in the United States of America and around 220 VAC in some other countries. Some of the internal electrical components of the display systems operate with ac voltages and currents, for example, transformers. However, other internal electrical components of the display systems operate with direct current (dc) voltages and currents, for example, LED strings used for backlighting purposes.

To drive the LED strings, the conventional electronic display systems first convert the ac voltages and currents received from the wall outlets into dc voltages and currents by using a rectifier circuit. One of ordinary skill in the art will appreciate that the rectifier circuit can be a half wave rectifier or a full wave rectifier. Typically, the output of the rectifier circuit is further processed by a dc to dc converter. The dc to dc converter can be a switch regulator or a linear regulator. The dc to dc converter can be a part of a power factor correction circuitry. Next, the output of the dc to dc converter is scaled, typically by using another dc to dc converter, to obtain the desired drive voltage for the LED strings. It would be desirable to reduce the number of display system components by eliminating the dc to dc scaling converter.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

In accordance with one or more aspects and corresponding disclosure thereof, various aspects are described in connection with an intelligent light emitting diode driver having power factor correction capability. According to related aspects, a circuit for controlling a set of light emitting diode strings is provided. The circuit includes a programmable controller having one or more associated detectors, the programmable controller obtains data related to one or more measurable parameters for a set of light emitting diode strings via the associated detectors, determines a drive value based at least in part on the measurable parameters, and generates a control signal based on the drive value, a power supply system, having power factor correction capability, obtains the control signal as a first input, and an ac waveform voltage as a second input, and generates a drive voltage based at least in part on at least one of the control signal or the ac waveform voltage, and a programmable variable resistor included in the power supply for setting a set of operating conditions for the input current and voltage control loop that facilitate the power supply in generating the drive voltage.

Another aspect relates to a method for controlling a set of light emitting diode strings. The method includes determining at least one characteristic for at least one light emitting diode included in the light emitting diode strings, generating a control signal for a drive voltage for at least one of the light emitting diode strings based at least in part on the characteristics, performing a power factor correction related to ac current and ac voltage waveforms inputs for a power supply, and producing the drive voltage based at least in part on the control signal, and a value of a programmable variable resistor located in an input current and voltage control loop.

Yet another aspect relates to a system facilitating control of a set of light emitting diode strings. The system includes a programmable controller associated with a set of detectors that measures data including at least one of an ambient temperature, a luminous intensity, or a wavelength of light emitted by at least one of the light emitting diodes in the light emitting diode strings, the controller determines a drive value based at least in part on the data, and generates a control signal based on the drive value, a power supply having power factor correction capability that obtains the control signal as a first input, and an ac waveform voltage as a second input, and generates a drive voltage based at least in part on the ac voltage, and a programmable variable resistor included in the power supply that sets a set of input current and voltage control loop operating conditions that facilitate the power supply in generating the drive voltage, wherein a state machine controls the programmable variable resistor based at least in part on at least one of the following inputs: a zero crossing signal generated via a zero crossing detector, an input line voltage value obtained via an input voltage controlled input current loop, a discrete error voltage obtained via an operational amplifier, a limit triode region signal obtained via a triode region detector, or an input voltage feedforward correction signal obtained via an input voltage feedforward correction loop.

To the accomplishment of the foregoing and related ends, the one or more aspects comprise the features hereinafter fully described and particularly pointed out in the claims. The following description and the annexed drawings set forth in detail certain illustrative features of the one or more aspects. These features are indicative, however, of but a few of the various ways in which the principles of various aspects may be employed, and this description is intended to include all such aspects and their equivalents.

BRIEF DESCRIPTION OF THE DRAWINGS

The above and other objects and advantages of the present innovation will be apparent upon consideration of the following detailed description, taken in conjunction with the accompanying drawings, in which like reference characters refer to like parts throughout, and in which.

DETAILED DESCRIPTION

Various aspects are now described with reference to the drawings. In the following description, for purposes of explanation, numerous specific details are set forth in order to provide a thorough understanding of one or more aspects. It may be evident, however, that such aspect(s) may be practiced without these specific details.

As used in this application, the terms "component," "module," "system" and the like are intended to include a computer-related entity, such as but not limited to hardware, firmware, a combination of hardware and software, software, or software in execution. For example, a component may be, but is not limited to being, a process running on a processor, a processor, an object, an executable, a thread of execution, a program, and/or a computer. By way of illustration, both an application running on a computing device and the computing device can be a component. One or more components can reside within a process and/or thread of execution and a component may be localized on one computer and/or distributed between two or more computers. In addition, these components can execute from various computer readable media having various data structures stored thereon. The components may communicate by way of local and/or remote processes such as in accordance with a signal having one or more data packets, such as data from one component interacting with another component in a local system, distributed system, and/or across a network such as the Internet with other systems by way of the signal.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

Various aspects or features will be presented in terms of systems that may include a number of devices, components, modules, and the like. It is to be understood and appreciated that the various systems may include additional devices, components, modules, etc. and/or may not include all of the devices, components, modules etc. discussed in connection with the figures. A combination of these approaches may also be used.

Figure 4:
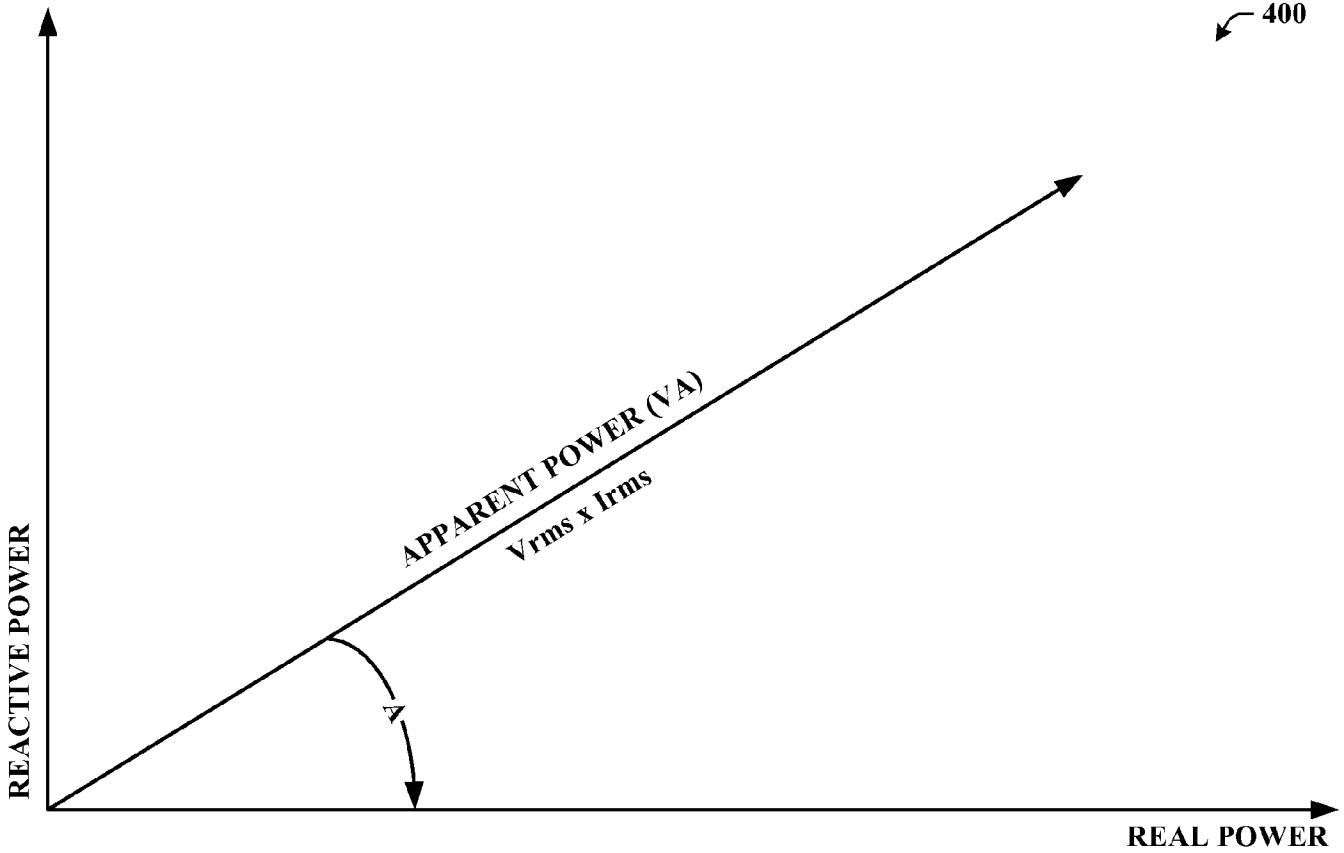
FIG. 4 is a plot illustrating an exemplary relationship between reactive, apparent and real power for an electrical power system in accordance with an aspect of the subject specification.

The present innovation relates to circuits and methods for controlling one or more light emitting diodes (LEDs) or LED drivers. The luminosity of a LED is a function of the power generated by the drive voltage applied to the LED and the drive current flowing through the LED. FIG. 4 illustrates a power components relationship for an exemplary electrical power system. Specifically, FIG. 4 shows the relationship between reactive power, apparent power and real power of an electrical power system. Real power is the capacity of the circuit for performing work in a particular time. Apparent power is the product of the current and the voltage of the circuit. Due to the energy stored in the load and returned to the source, or due to a non-linear load that distorts the wave shape of the current drawn from the source, the apparent power can be greater than the real power. Power factor (PF) is the ratio of real power to apparent power and can be mathematically defined as follows:

$$\text{PF}=\text{Real Power}\div\text{Apparent Power}$$

$$\text{PF}=(V_{rms}\times I_{rms}\times\text{Cosine } A)\div(V_{rms}\times I_{rms})$$

$$\text{PF}=\text{Cosine A}$$

Wherein, rms means root mean square, ÷ means division, × means multiplication, and A is the angle between apparent power and real power as shown in FIG. 4.

Figure 5:
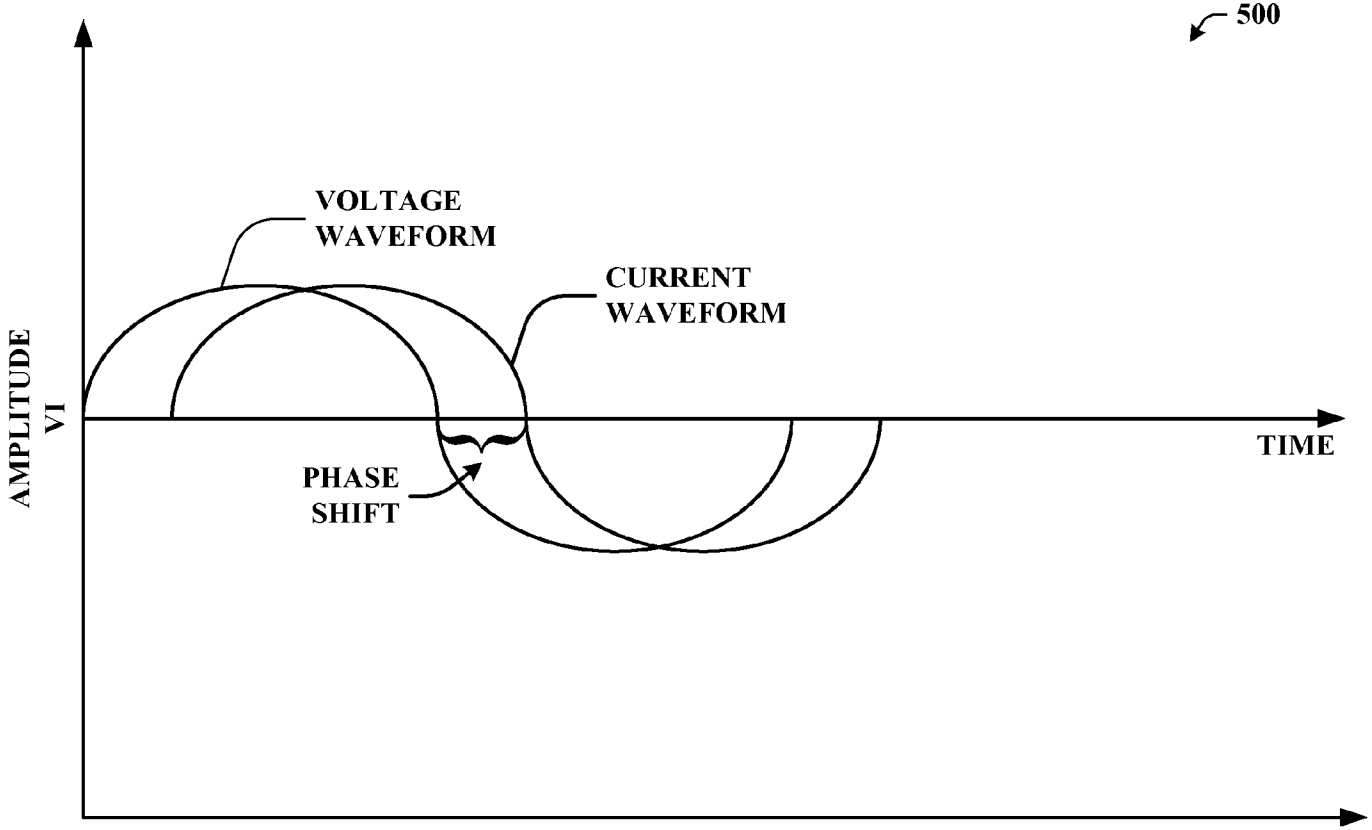
FIG. 5 illustrates an example phase lag between ac voltage and current waveforms in accordance with an aspect of the subject innovation.

FIG. 5 illustrates a relationship between sinusoidal current and voltage waveforms as a function of time (t). In this relationship, the current waveform (I) lags the voltage waveform (V) by a phase difference denoted by the "Phase Shift." The "Phase Shift" shown in FIG. 5 corresponds to the angle "A" shown in FIG. 4. In other words, where the voltage and current waveforms are purely sinusoidal, the Power Factor is the cosine of the phase angle (A) between the current and voltage sinusoid waveforms. The Power Factor equals 1 when the voltage and current waveforms are in phase and is zero when the current waveform leads or lags the voltage waveform by 90 degrees. Ideally, a Power Factor of 1 is desired in power systems because that provides maximum power to the load.

The Power Factor is a number between 0 and 1 that is frequently expressed as a percentage, for example. 0.7 PF means 70 percent power factor. In an electric power system, a load with low power factor draws more current than a load with high power factor for the same amount of useful power transferred. The higher currents increase the energy lost in the distribution system, and require larger wires and other equipment. Because of the costs of larger equipment and wasted energy, electrical utilities will usually charge a higher cost to industrial or commercial customers where there is a low power factor.

Linear loads with low power factor (such as induction motors) can be corrected with a passive network of capacitors or inductors. Non-linear loads, such as rectifiers, distort the current drawn from the system. In such cases, active power factor correction is used to counteract the distortion and raise the power factor.

The circuit of the present innovation comprises a programmable decentralized controller coupled to one or more detectors, wherein the one or more detectors are configured to detect one or more measurable parameters of one or more LEDs or LED drivers. The controller is configured to receive information from the one or more detectors related to the one or more measurable parameters. The controller is also configured to adjust one or more controllable parameters until one or more detectors indicate that one or more measurable parameters in one of the LEDs or LED drivers meet(s) a reference condition. The controller is configured to then set one or more of the controllable parameters to operate at a value relative to the value of the controllable parameters at which the reference condition was met.

The present innovation also includes a method for controlling one or more LEDs or LED drivers. The method comprises detecting one or more measurable parameters of the one or more LEDs or LED drivers, receiving information from the one or more detectors related to the one or more measurable parameters, adjusting one or more controllable parameters of the one or more LEDs or LED drivers until the measurable parameters in the one or more LEDs or LED drivers meet a reference condition, and setting the controllable parameters to operate at a value relative to the value of the controllable parameters at which the reference condition was met, wherein the setting is performed by a programmable decentralized controller.

Figure 6:
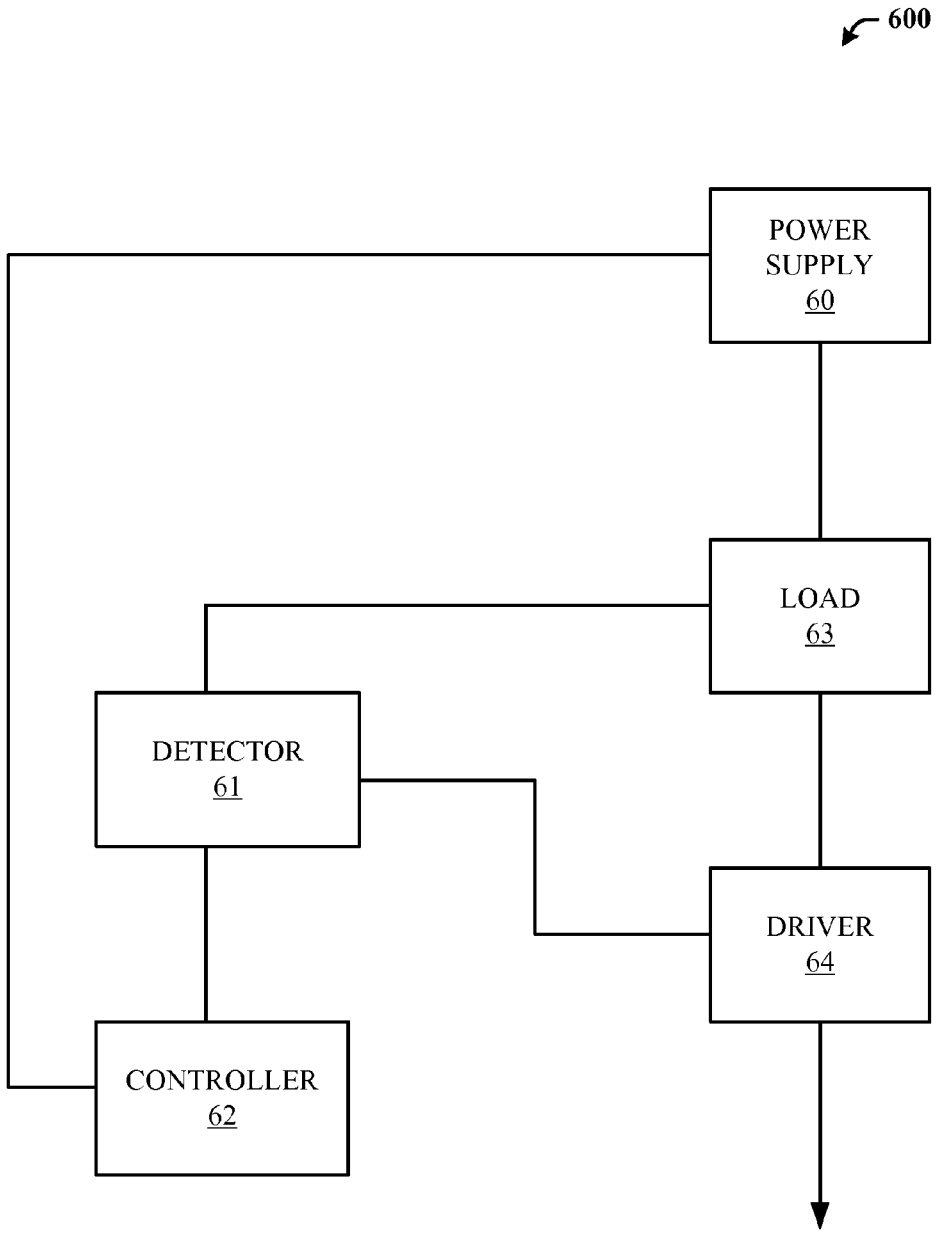
FIG. 6 illustrates an example embodiment of a controller in accordance with an aspect of the present specification.

FIG. 6 illustrates a configuration in which the circuit 600 for controlling at least one parameter in a load 63 or load driver 64 of the present innovation can be used. The load 63 can be a string or array of LEDs and the driver 64 can be a driver for an LED string or array. In FIG. 6, a detector 61 is coupled to the load 63 and/or the driver 64. The detector 61 detects measurable parameters in the load 63 and/or driver such as temperature, voltage, current, luminous intensity, or luminous wavelength distribution or color. The triode region detector of U.S. patent application Ser. No. 12/111,114, the full disclosure of which is herein incorporated by reference, is an example of a detector 61 that can be used with the controller 62 of the present innovation. The load 63 is coupled to a power supply 60 that provides the drive voltage for the LED string 63. The load 63 is also coupled to a driver 64 that regulates the operation of the load 63. The controller 62 is coupled to the power supply 60 such that the controller 62 can control the drive voltage from the power supply 60. As shown in FIG. 6, the programmable controller 62 of the present innovation is decentralized. That is, the controller 62 is not a necessary part of the control loop of the power supply loop, but it can influence the power supply loop. In the example of FIG. 6, the power supply 60 can be initiated and the driver 64 can bring the load 63 to a set of operating conditions without any interaction from the programmable decentralized controller 62. Therefore, the driver loop comprising the power supply 60, the load 63, and the driver 64 can operate independently of the controller 62. However, at the occurrence of some event or the passage of some interval, the programmable decentralized controller can adjust the operation of the driver loop to calibrate and/or optimize a parameter of the driver loop.

In the following example, the detector 61 is a triode region detector, for example, the triode region detector disclosed in U.S. patent application Ser. No. 12/111,114. However, this is merely exemplary and is not limiting. In the case where the detector 61 is a triode region detector coupled to an LED driver 64, the controller 62 is configured to control the driver 64 and/or the power supply 60 to step the drive voltage down until the triode region detector 61 sets the triode region flag. The controller 62 then causes the power supply 60 and or the driver 64 to operate at a drive voltage some programmable level above the drive voltage at which the triode flag was set. The controller 62 causes the power supply 60 and/or the driver 64 to set the drive voltage sufficiently high to avoid operation in the triode region, thereby optimizing power dissipation in the circuit and improving circuit efficiency.

In the above example, the controller 62 causes the power supply 60 and/or the driver 64 to step down the drive voltage. However, the controller 62 can also cause the power supply 60 and/or the driver 64 to step up the drive voltage according to the desired application for the controller 62. Also, the controller 62 can control some other controllable parameter such as current, power, or resistance depending on the application. Also, in addition to the controller 62 causing the drive voltage to step up or step down, the controller 62 can wait until the drive voltage or other controllable parameter is increased or decreased until a reference condition is met. Moreover, in the above example, the controller 62 causes the power supply 60 and/or the driver 64 to set the drive voltage sufficiently high to avoid operating in the triode region. Depending on the application of the controller 62, the controller 62 can cause the power supply 60 and/or the driver 64 to set the drive voltage at any point relative to drive voltage at which the reference condition, as detected by the detector 61, is met. The reference condition can be a constant offset from the detected parameter such that the reference condition is met when the detected parameter is within a positive or negative constant from some reference for the detected parameter. The reference condition can be a function of the detected parameter and a reference parameter. The reference condition can also be a function of multiple measured parameters such as a combination of voltage, wavelength and intensity.

Figure 7:
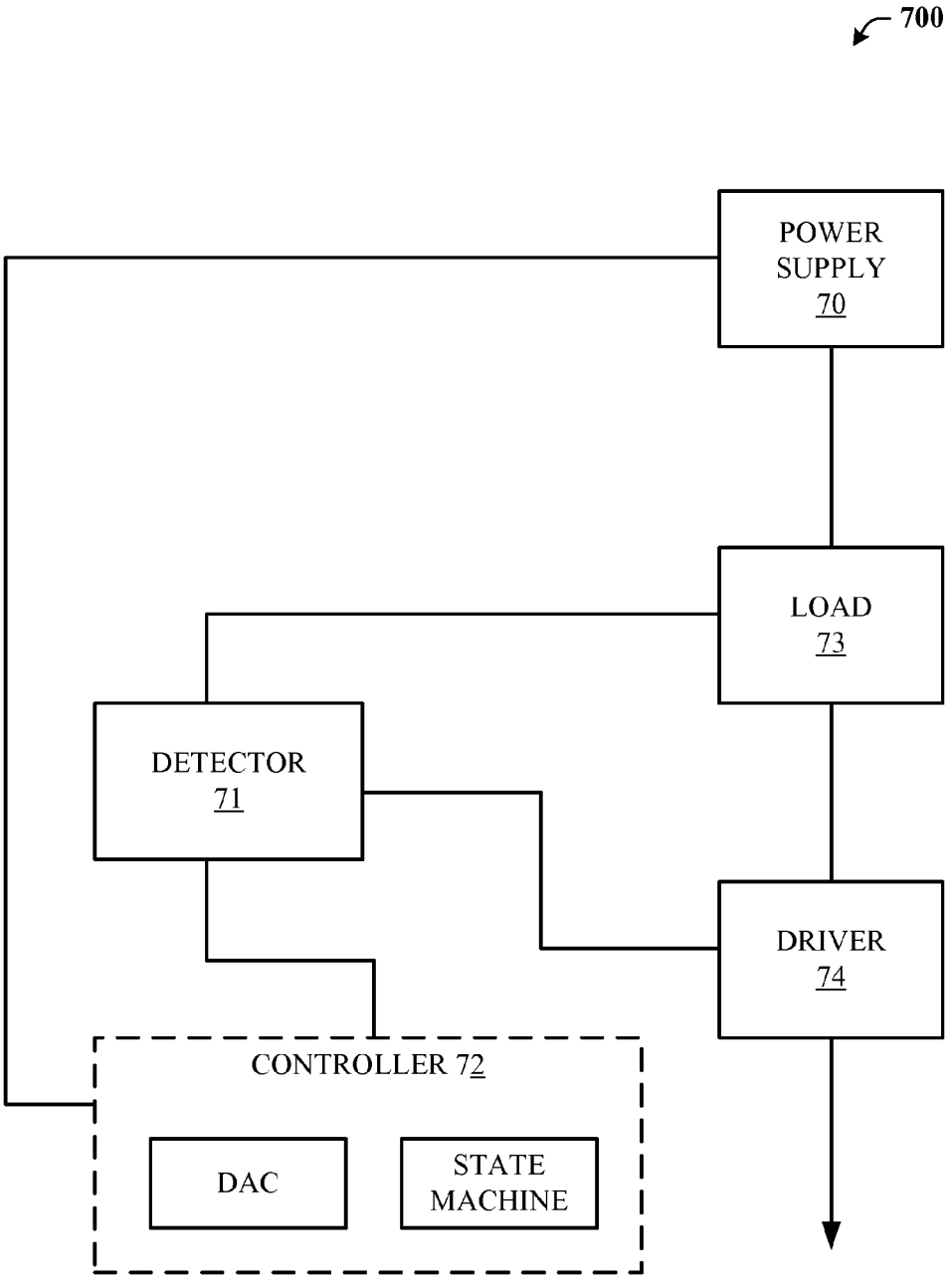
FIG. 7 illustrates an example embodiment of a controller in accordance with an aspect of the present specification.

As show in FIG. 7, the controller 72 can comprise a digital-to-analog converter ("DAC") and a state machine in one embodiment. The programmable controller of the present innovation can be programmable and may be implemented in analog, digital or some combination of these devices and in hardware, software, firmware, or some combination of these media. The detector 71, the power supply 70, the load 73 and the driver 74 can be structurally and functionally same or similar to their counterparts in FIGS. 6 61, 60, 63 and 64 respectively.

Figure 8:
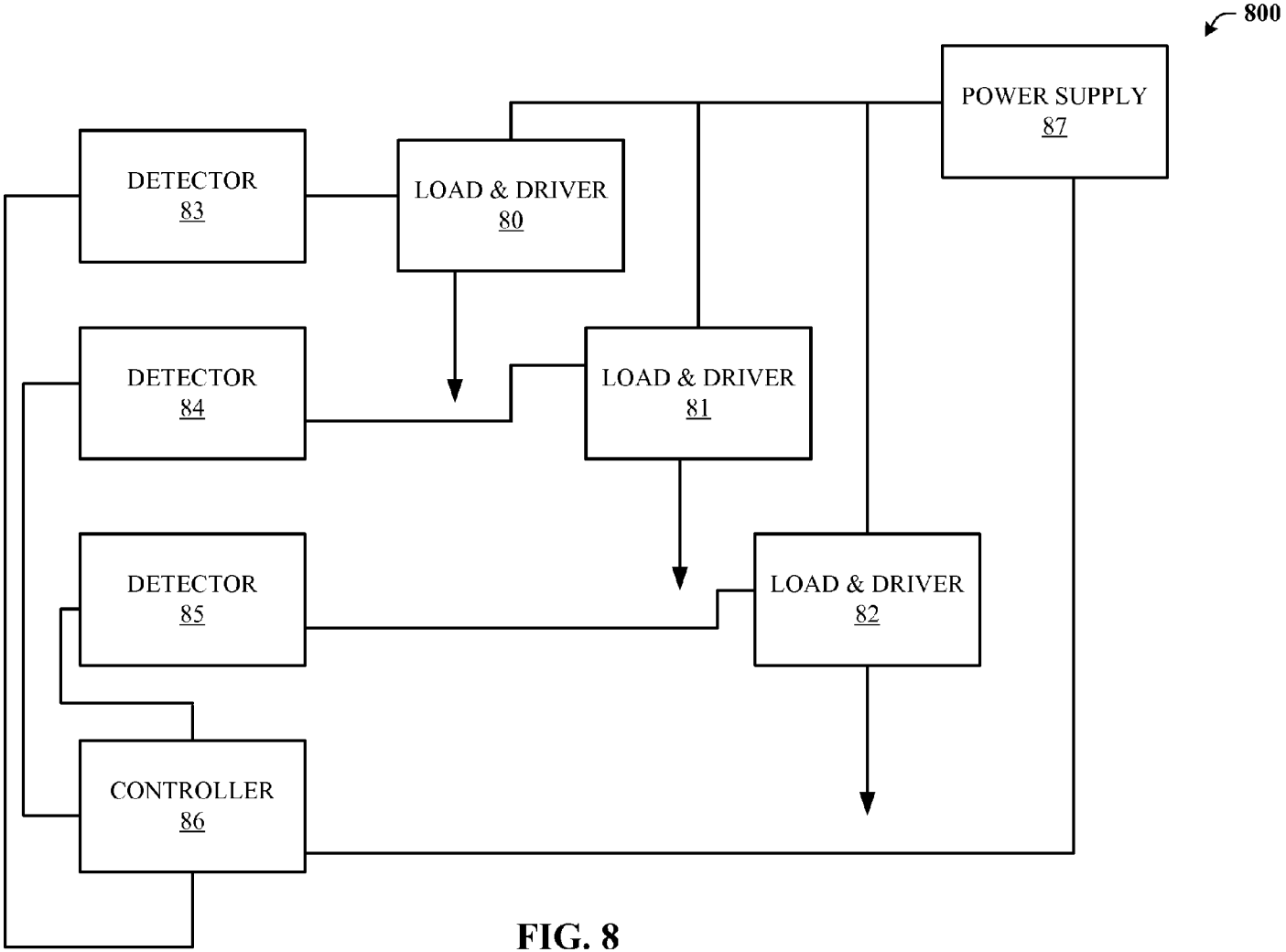
FIG. 8 illustrates an example embodiment of a controller in accordance with an aspect of the present specification.

As shown in FIG. 8, the programmable decentralized controller 86 can be coupled to one or more detectors 83, 84, 85 which are coupled to one or more loads and drivers 80, 81, 82. In this embodiment, the power supply 87 is coupled to one or more loads and drivers 80, 81, 82. The controller 86 operates as discussed above, causing the power supply 87 and/or the drivers 80, 81, 82 to adjust a controllable parameter until at least one of the detectors 83, 84, 85 detects that a reference condition is met in the loads and/or drivers 80, 81, 82 to which the detector is coupled. The controller 86 can cause the power supply 87 and/or drivers 80, 81, 82 to operate at a setting of the controllable parameter relative to the value of the controllable parameter at which the reference condition in at least one of the loads or drivers 80, 81, 82 was met. The trigger that the controller 86 uses to cause the power supply 87 and/or drivers 80, 81, 82 to set the controllable parameter can be detection that the reference condition is met in one of the loads or drivers 80, 81, 82 or the trigger can be some combination of the reference condition being met in more than one of the loads or drivers 80, 81, 82. The controller 86 can be programmed to induce a delay between the time the reference condition in one or more of the loads or drivers 80, 81, 82 is met and the time the controllable parameter is set.

Figure 9:
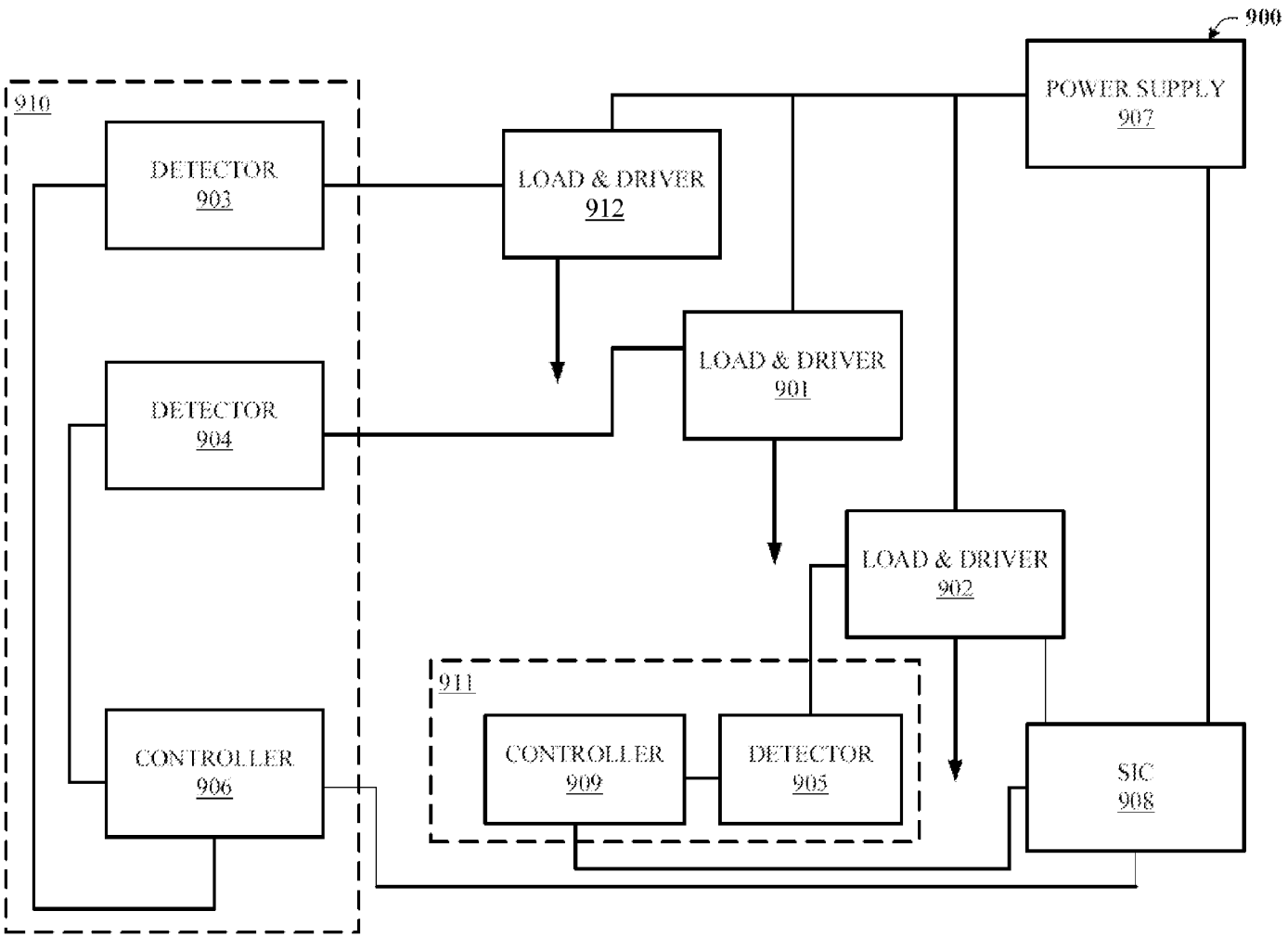
FIG. 9 illustrates an example embodiment of a controller in accordance with an aspect of the present specification.

As shown in FIG. 9, the controller 906 of the present innovation can be used in conjunction with one or more other controllers 909. In the example of FIG. 9, an integrated circuit chip 910 comprises the controller 906 and detectors 903, 904. The integrated circuit chip 910 can also comprise the controller 909, a detector 905, and a driver 902. In an alternate embodiment, a second integrated circuit chip 911 can comprise the controller 909 and the detector 905. The detectors 903, 904, 905 are coupled to loads and drivers 912, 901, 902 respectively. The loads and drivers 912, 901, 902 are coupled to a power supply 907. The controllers 906, 909 can be coupled to a system for inter-chip communication ("SIC") 908 such as that disclosed in U.S. patent application Ser. No. 12/046,280, the entire disclosure of which is herein incorporated by reference. When the detectors 903, 904, 905 detect that a reference condition is met in one of the respective loads and/or drivers 912, 901, 902, or in some combination of the respective loads and drivers 912, 901, 902, at least one of the controllers 906, 909 causes the power supply 907 to set the controllable parameter in the loads and drivers 912, 901, 902.

The controller 62, 72, 86 or 906 of the present innovation, which can be integrated in a liquid crystal display having LEDs, LED lighting system, or LED related driving system, for example, can set one or more controllable parameters at some regular or adjustable interval or upon certain events such as at initial start up to or upon a change in some measurable system parameter. The controller 62, 73, 86 or 906 can also initiate the adjusting of the controllable parameters relative to a change in an additional measurable system parameter in at least one of the one or more loads and/or drivers. The additional measurable parameter can be the same as the measurable parameter that is detected by the detectors, or it can be a different measurable parameter.

Figure 10:
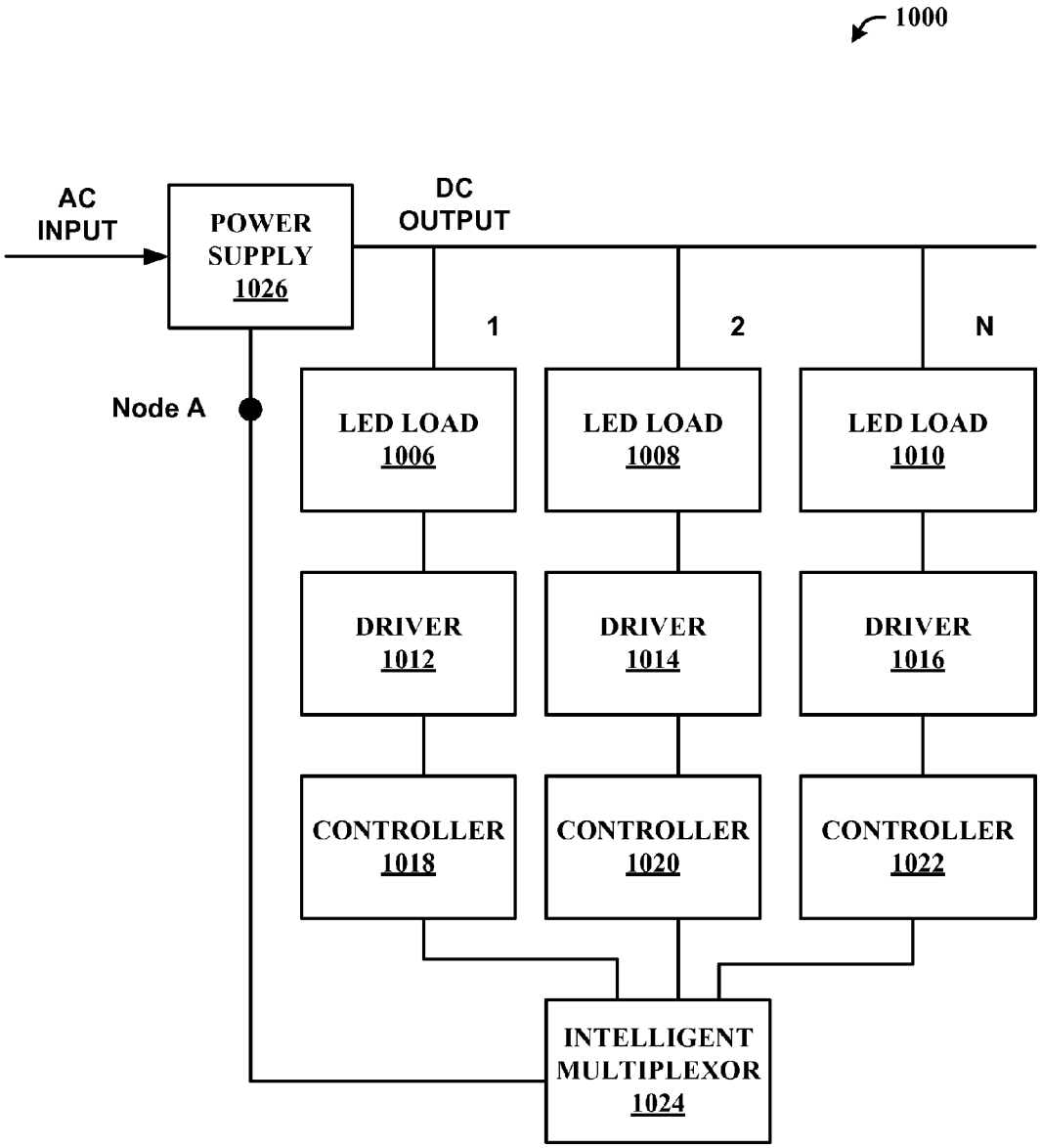
FIG. 10 illustrates an example embodiment of a controller in accordance with an aspect of the present specification.

FIG. 10 illustrates a functional block diagram for an exemplary system 1000 of the present innovation. The system 1000 can be implemented in a liquid crystal display, for example, and can be used to control the LED strings used for backlighting. Additionally or alternatively, the system 1000 can be implemented in a light emitting diode lighting system, or light emitting diode related driving system. One of ordinary skill in the art will appreciate that the application of the system 1000 is not limited to LED loads and that other loads involved in television and lighting applications are also applicable to the system 1000. One of ordinary skill in the art will also appreciate that the system 1000 is not limited to display applications and can be used for other applications, for example, for LED street lighting.

The system 1000 includes a power supply 1026 having power factor correction capability. The power supply 1026 provides the drive voltage to multiple strings of LEDs 1, 2 and n. The power supply 1026 can be implemented by using one or more integrated circuit (IC) chips. The LEDs 1006 of string 1 are coupled to a LED driver 1012 and a controller 1018. The LEDs 1008 of string 2 are coupled to a LED driver 1014 and a controller 1020. The LEDs 1010 of string n are coupled to a LED driver 1016 and a controller 1022. The driver 1012, 1014 or 1016 can include a field effect transistor for controllably providing a current path from the power supply 1002 to the ground by way of the LED string 1, 2 or n respectively. The controller 1018, 1020 or 1022 can be representative of the controller 42, 53, 66 or 906 and can also be referred to as an efficiency optimizer because one of its purposes is to optimize the efficiency of the LED string 1, 2 or n respectively.

The controller 1018, 1020 or 1022 can be a part of a centralized controller that controls the operation of the LED strings 1, 2 and n, or an independent de-centralized controller that can influence the operation of the LED strings 1, 2 and n but is not a part of the centralized controller. The controllers 1018, 1020 and 1022 can be situated on the same integrated circuit chip or different integrated circuit chips.

As discussed above, the controllers 1018, 1020 and 1022 receive inputs from one or more detectors indicative of the operations of their respective strings 1, 2 and n, or, of the ambient conditions proximate to their respective strings 1, 2 and n. One such input can include the triode region voltage detection. The triode region refers to an operation state of a LED string 1, 2 or n in which the current flowing through the LED string 1, 2 or n increases as a direct result of an increase in the drive voltage supplied by the power supply 1026. Outside the triode region, the increase in the drive voltage supplied by the power supply 1026 does not directly change the current flowing through a LED string 1, 2 or n. The upper voltage limit of the triode region represents the minimum drive voltage that is required to drive a LED string 1, 2 or n properly.

In one embodiment of the present innovation, the controllers 1018, 1020 and 1022 are coupled to the power supply by way of an intelligent multiplexer 1024. In another embodiment of the present innovation, the controllers 1018 and 1020 and 1022 are coupled to the power supply 1026 without using the intelligent multiplexer 1024. In the embodiment that uses the intelligent multiplexer 1024, the purpose of the intelligent multiplexer 1024 is to provide additional flexibility in the interaction between the power supply 1026 and the controllers 1018, 1020 and 1022. For example, the multiplexer 1024 can sequence the timing of interaction of the various strings 1, 2 and n with the power supply 1026 or can allow only certain strings 1, 2 or n to interact with the power supply 1026.

The power supply 1026 is typically available in power supplies of television sets and other electronic systems and the system 1000 of the present innovation can intelligently and adaptively optimize the drive needs of the LED strings 1, 2 and n by transparently inheriting the benefits of the power supply available in a television set in which the system 1000 is implemented, for example. The system 1000 can be coupled to the power supply 1026 at Node A shown in FIG. 10. The power supply 1026 receives an AC power input, for example, from a wall outlet, and an input from the system 1000 at Node A, and provides a DC power output to the LED strings 1, 2 and n.

In the present innovation, a control signal representative of the desired drive voltage for the LED string 1, 2 and n is injected at Node A. The control signal can include, for example, a current signal representative of the limit (e.g., upper or lower) of the triode region voltage for the lead string. For example, the lead string can include the LED string 1, 2 or n that has the highest upper limit of the triode region voltages of all the LED strings 1, 2 and n. The controller 1018, 1020 or 1022 of the present innovation can monitor the triode region voltage limit for the various LED strings 1, 2 and n from time to time, for example, upon initialization and periodically thereafter. The present innovation thus provides for efficient power management by allowing the system 1000 to only provide the necessary drive voltage and by eliminating the need for any dc to dc scaling of the output voltage of the power supply 1026. In the conventional systems, drive voltages much higher than the upper limit of the triode region voltage are typically provided, to provide adequate headroom, to account for worst case LED manufacturing variations and physical changes in the LED strings that can occur with time and temperature including replacement of damaged LEDs with different LEDs. Moreover, in the conventional systems, an intermediate dc to dc power supply is placed between the power supply 1026 and the LED strings 1, 2 and n to scale the output of the power supply 1026 into the drive voltage for the LED strings. The present innovation eliminates the need for the intermediate dc to dc power supply because the power supply 1026 provides the desired drive voltage based on the control signal provided at Node A. The controllers 1018, 1020 and 1022 of the present innovation provide for on-the-fly adjustments to the drive voltages by evaluating the triode region limits from time to time and by eliminating the intermediate dc to dc scaling converter that is conventionally placed between the power supply 1026 and the LED strings 1, 2 and n. The elimination of the intermediate dc to dc scaling converter provides savings in terms of circuitry components and power and also provides for adaptive power adjustments to the LED strings. The present innovation thus reduces the wastage of power and enhances the effectiveness and efficiency of the power distribution system.

The intelligent multiplexer 1024 provides the power supply 1026 with a current signal (or alternately a voltage signal) indicative of the desired power supply voltage for driving the LED strings 1, 2 and n. Power supplies with built in power factor correction modules are generally available inside television sets and other consumer display systems. For example, the UC3854 integrated circuit chip made by the Unitrode Corporation, and the LT1249 integrated circuit chip made by the Linear Technology Corporation provide power correction circuitry and are used in television sets. Node A of the system 1000 of the present innovation can be coupled to Pin Number 11 of the UC3854 chip (Vsense Pin) and Pin Number 6 of the LTI249 chip (Vsense Pin).

Figure 11:
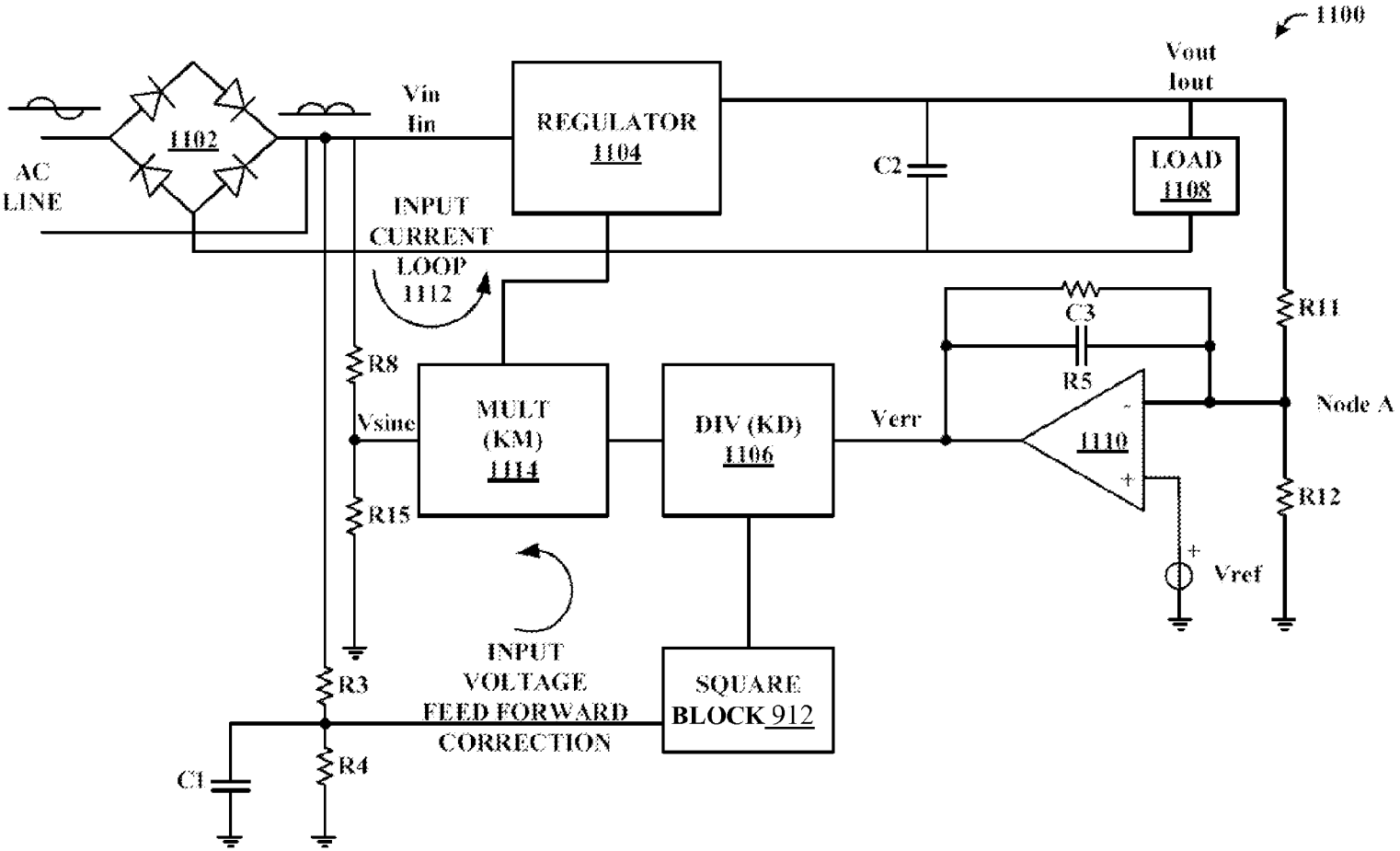
FIG. 11 illustrates an example system in accordance with an aspect of the subject specification.

FIG. 11 illustrates an example embodiment of the power supply 1026 illustrated in FIG. 10. The example power supply 1026 shown in FIG. 10 uses a boost regulator 1104. One of ordinary skill in the art will appreciate that power supplies with buck, boost, flyback forward and other power converters are available in the marketplace and are applicable to the present innovation. The power supply 1026 of FIG. 11 includes an input current control loop 1112 consisting of the boost power converters 1104, the multiplier 1114 and the resistors R8 and R15. An alternate current (AC) voltage line is coupled to a full wave rectifier 1102 and serves as an input to the power supply 1026. The full wave rectifier 1102 is coupled to the resistors R8 and R15. The full wave rectifier 1102 generates a full wave rectified sine wave voltage signal Vin. The boost switching regulator 1104 can force the line current (Iin) to following the envelope of the line voltage (Vin) and go in phase with it.

The output of the intelligent multiplexer 1024 can be coupled to the inverting input of the operational amplifier 1110. In the alternative, the output of the controller 1018, 1020 or 1022 can be coupled to the inverting input of the operational amplifier 1110. The current signal provided by the controller 1018, 1020 or 1022 or the intelligent multiplexer 1024 at Node A to the inverting input of the operational amplifier 1110 is indicative of the desired drive voltage of the LED strings 1, 2 and n. The non-inverting input of the operational amplifier 1110 is coupled to a reference voltage.

The output of the operational amplifier 1110 is coupled to the multiplier 1114. The operational amplifier 1110 provides the signal Verr to the multiplier 1114. The multiplier 1114 multiplies the Verr voltage signal with the Vsine voltage signal. The Vsine voltage signal is a full wave rectified sine wave voltage signal which results from drop in voltage of Vin caused by the resistors R8 and R15. The current generated by the input current control loop 1112 is proportional to the Verr voltage multiplied by Vsine voltage. The dc to dc converter 1104 provides the load 1108 with a drive voltage Vout and drive current Iout that is generated by using the control signal input received from the efficiency optimizer 1018, 1020 or 1022. The LED strings 1, 2 and n illustrated in FIG. 10 can be represented by the load 1108 in FIG. 11.

The present innovation provides an advantage over the conventional power factor correction systems because it directly uses the output of the efficiency optimizer 1018, 1020 or 1022 to drive the LED strings 1, 2, and n. In conventional power factor correction systems, an intermediate direct current (dc) to direct current (dc) power regulator interfaces with the PFC power supply to adjust the output voltage of the PFC power supply to a higher level to provide the LED strings with the worst case scenario drive voltage that is high enough drive a wide range of LEDs over production variations and operations in terms of time, temperature and other factors. In that scenario, the central controller communicates the desired drive voltages to the regulator. Thus, in the conventional systems, the output of the power factor correction circuitry is adjusted to provide the desired drive voltages and currents. In the systems and methods of the present innovation, the input to the power supply 1026 can be adjusted by the efficiency optimizer 1018, 1020 or 1022 to provide the desired drive voltages and currents to the LED strings 1, 2 and n. The resistors R3 and R4 and the square block 1116 and the division block 1106 form the line variation correction loop. One of ordinary skill in the art will appreciate that the techniques of the present innovation can be applied to wide ranging power supplies that are available in commercial display systems and that the power supply 1026 illustrated in FIG. 11 is merely an exemplary one.

Figure 12:
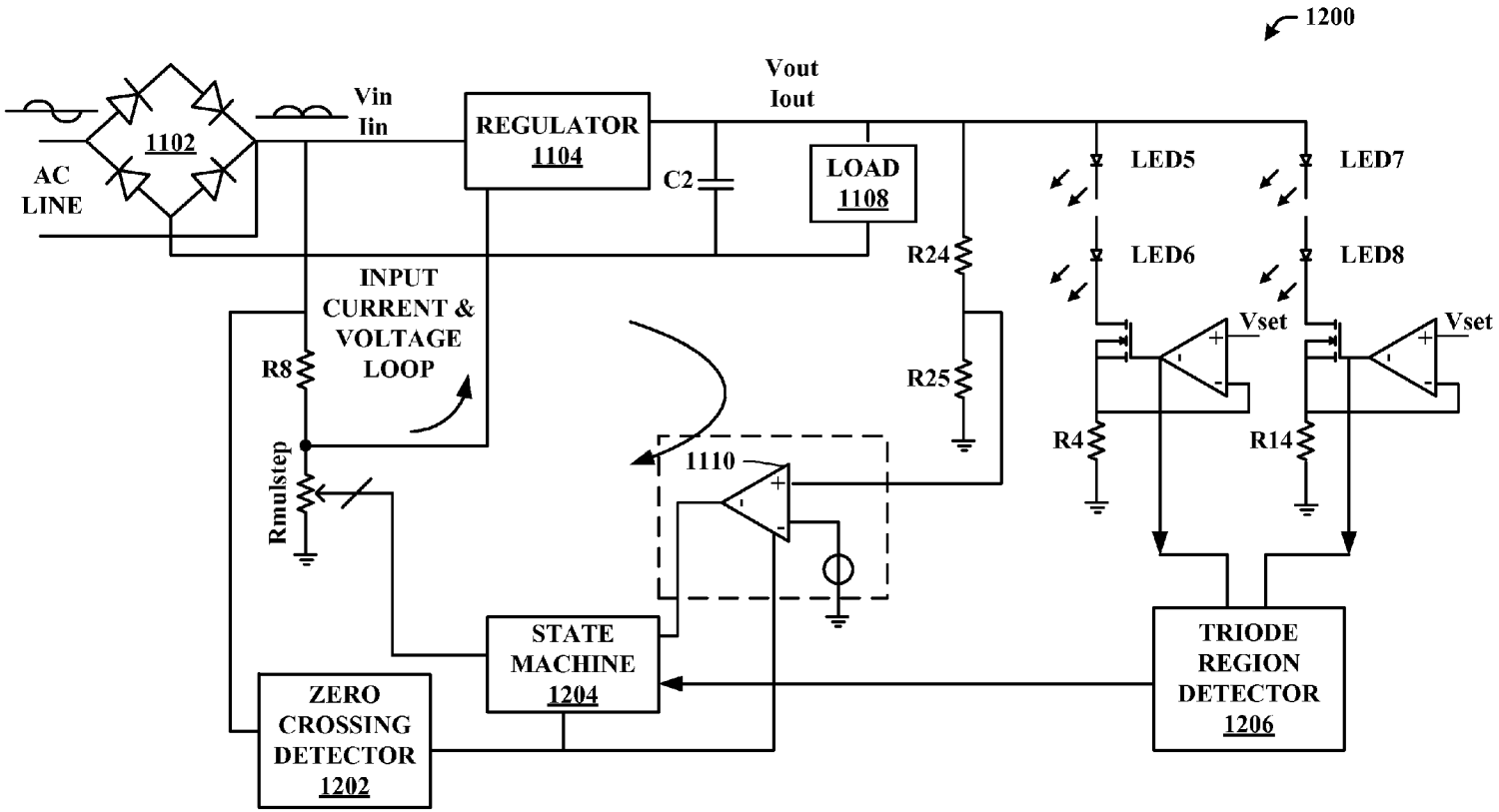
FIG. 12 illustrates an example system in accordance with an aspect of the subject specification.

FIG. 12 illustrates an additional example embodiment of the power supply 1026 illustrated in FIG. 10 in accordance with an aspect of the subject innovation. FIG. 11 shows a fully analog implementation of the power supply 1026, whereas FIG. 12 focuses on a discrete time system implementation. As discussed above, an alternate current (AC) voltage line is coupled to a full wave rectifier 1102 and serves as an input to the power supply 1026. However the input analog current control loop 1112 has been replaced by intelligent calibration techniques. For instance, the analog multiplier 1114 of FIG. 11 has been substituted in favor of the resistor network including R8 and Rmulstep, wherein Rmulstep is a programmable variable resistor that is controlled via the output of a state machine 1204 (discussed below).

A zero-crossing detector 1202 identifies the zero-crossing of the AC input waveform, or close to the zero-crossing of the half-sine wave output from the full-bridge rectifier 1102. The zero-crossing detector 1202 can be a low frequency sampling zero crossing-detector, because by examining the output voltage at about the same time every cycle, a substantial amount of the undesirable effects of ripple can be mitigated. In theory, the output voltage is at the average value when the AC waveform is a zero.

The output of the zero-crossing detector can be provided as input to the state machine 1204. In addition, the output of the zero-crossing detector 1202 can be provided to the operational amplifier 1110 for sampling and hold or other purposes. The operational amplifier 1110 can also obtain an input from the voltage divider consisting of a resistor R24 and a resistor R25. The operational amplifier 1110 provides Verr (discussed supra) as an input to the state machine 1204. In addition, the state machine 1204 obtains a signal detailing the upper bounds of the triode region from a triode detector 1206 (disclosed in the incorporated reference U.S. patent application Ser. No. 12/111,114).

In the previous example embodiment of FIG. 11, a multiplier was employed such that the current generated by the input current control loop 1112 was proportional to the Verr voltage multiplied by Vsine voltage. In this embodiment, the output of the state machine 1204 controls the programmable variable resistor Rmulstep that determines the input current and voltage control loop, wherein the output of the state machine 1204 is based at least on part the detected zero crossings of the input ac waveform, the upper triode region determined via the triode region detector 1206, scaled full rectified line Voltage (e.g., Vsine), and the Verr provided by the operational amplifier 1110.

Figure 13:
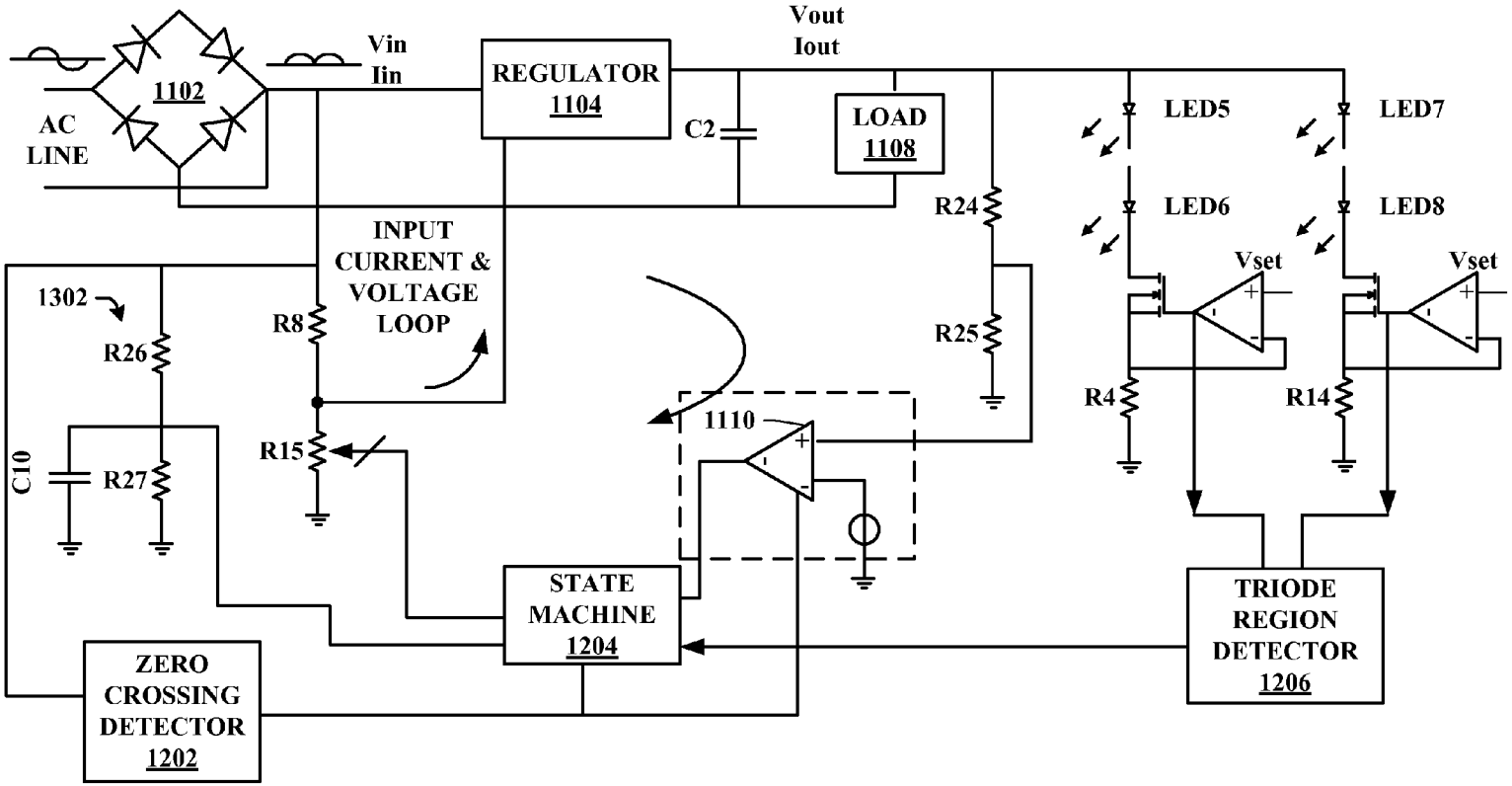
FIG. 13 illustrates an example system in accordance with an aspect of the subject specification.

FIG. 13 illustrates yet another embodiment of the power supply 1026 illustrated in FIG. 10 in accordance with an aspect of the subject innovation. FIG. 13 is similar, but not identical to the embodiment disclosed in FIG. 12. In particular, the power supply 1026 of FIG. 13 includes an input voltage feedforward correction loop 1302 that consist of, by way of example, the resistors R26, R27, and the capacitor C10. The input voltage feed forward correction loop 1302 can be employed by the state machine 1204 to militate against possible wide control range variation issues due to the $V_{in}$, $rms^2$ changes. For instance, the feedforward input 1302 can be implemented as a vector which is used by the state machine 1204 for signal processing purposes, such as, to select a table, a mapping, and so forth that is adaptive to the value of $V_{in}$.

Figure 14:
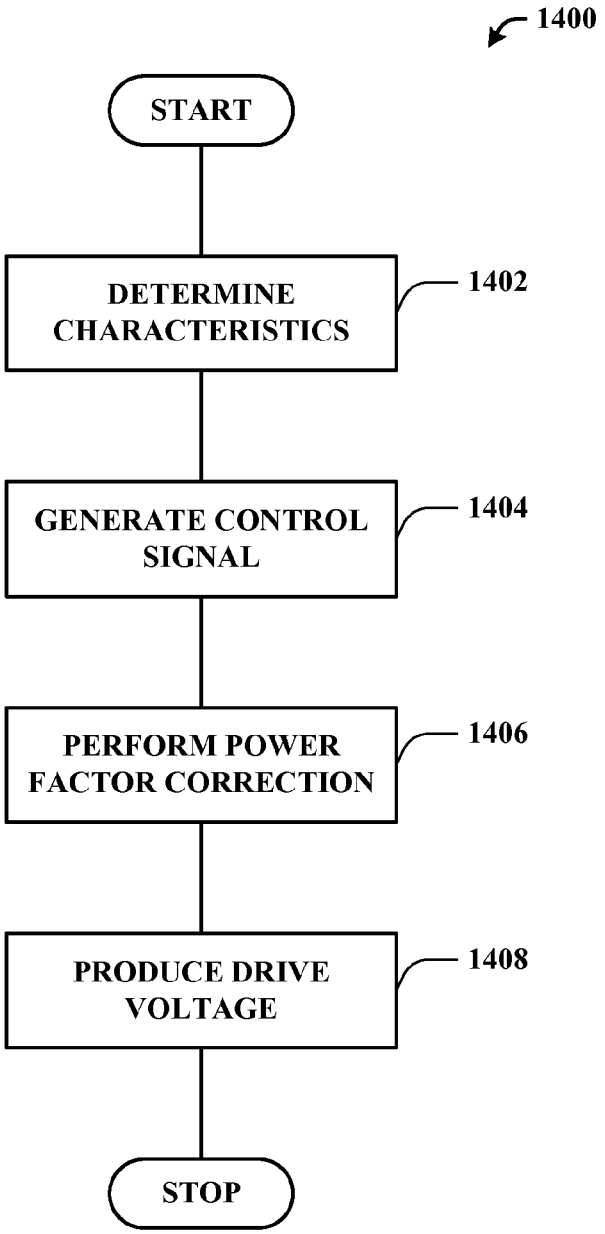
FIG. 14 illustrates an example methodology in accordance with an aspect of the subject specification.

In view of the example systems described supra, methodologies that may be implemented in accordance with the disclosed subject matter will be better appreciated with reference to the flow chart of FIG. 14. While for purposes of simplicity of explanation, the methodologies are shown and described as a series of blocks, it is to be understood and appreciated that the claimed subject matter is not limited by the order of the blocks, as some blocks may occur in different orders and/or concurrently with other blocks from what is depicted and described herein. Moreover, not all illustrated blocks may be required to implement the methodologies described hereinafter.

Figure 1:
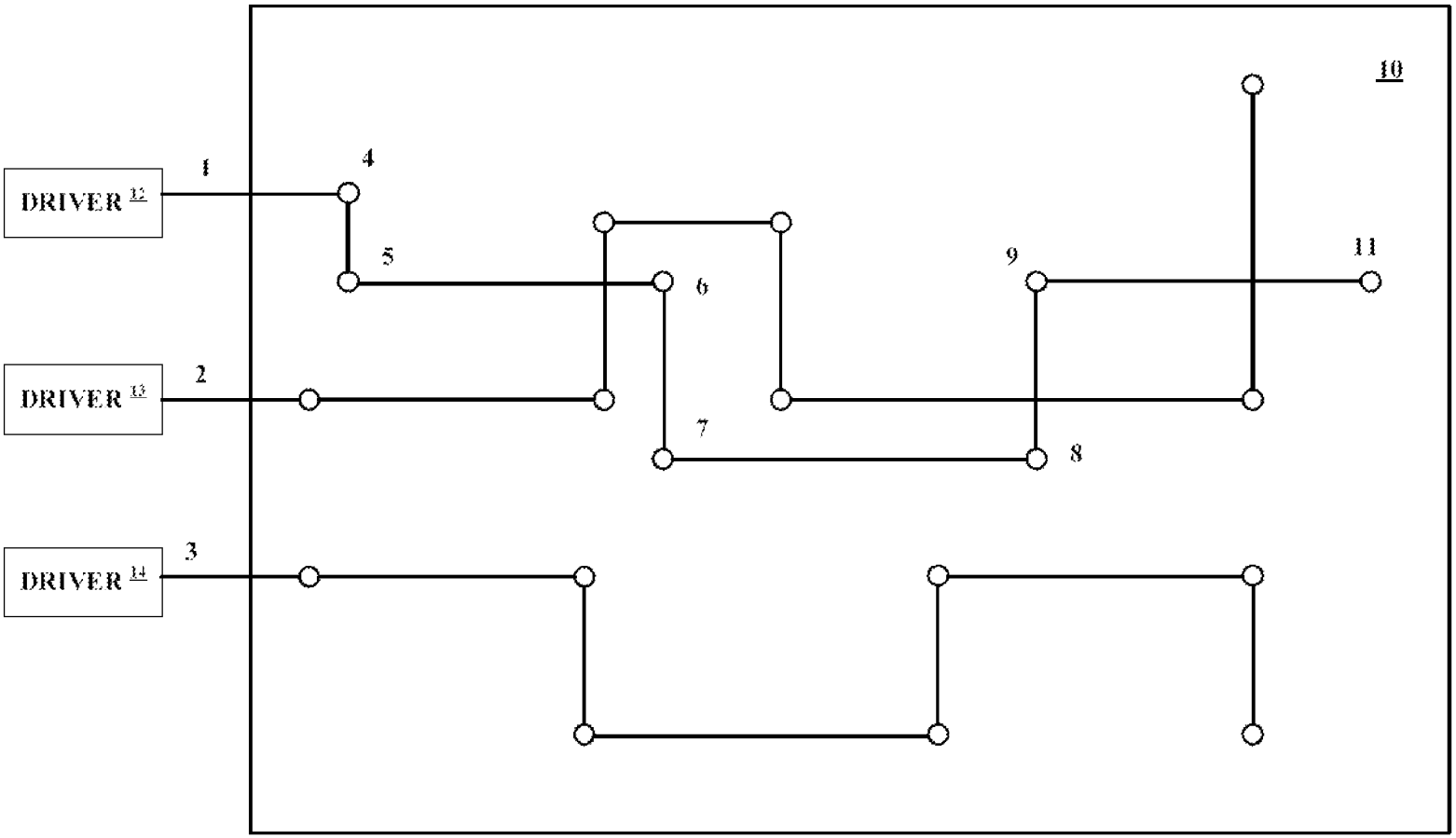
FIG. 1 (Prior Art)
FIG. 1 illustrates an example display implementing light emitting diode strings in accordance with an aspect of the subject specification.
Figure 2:
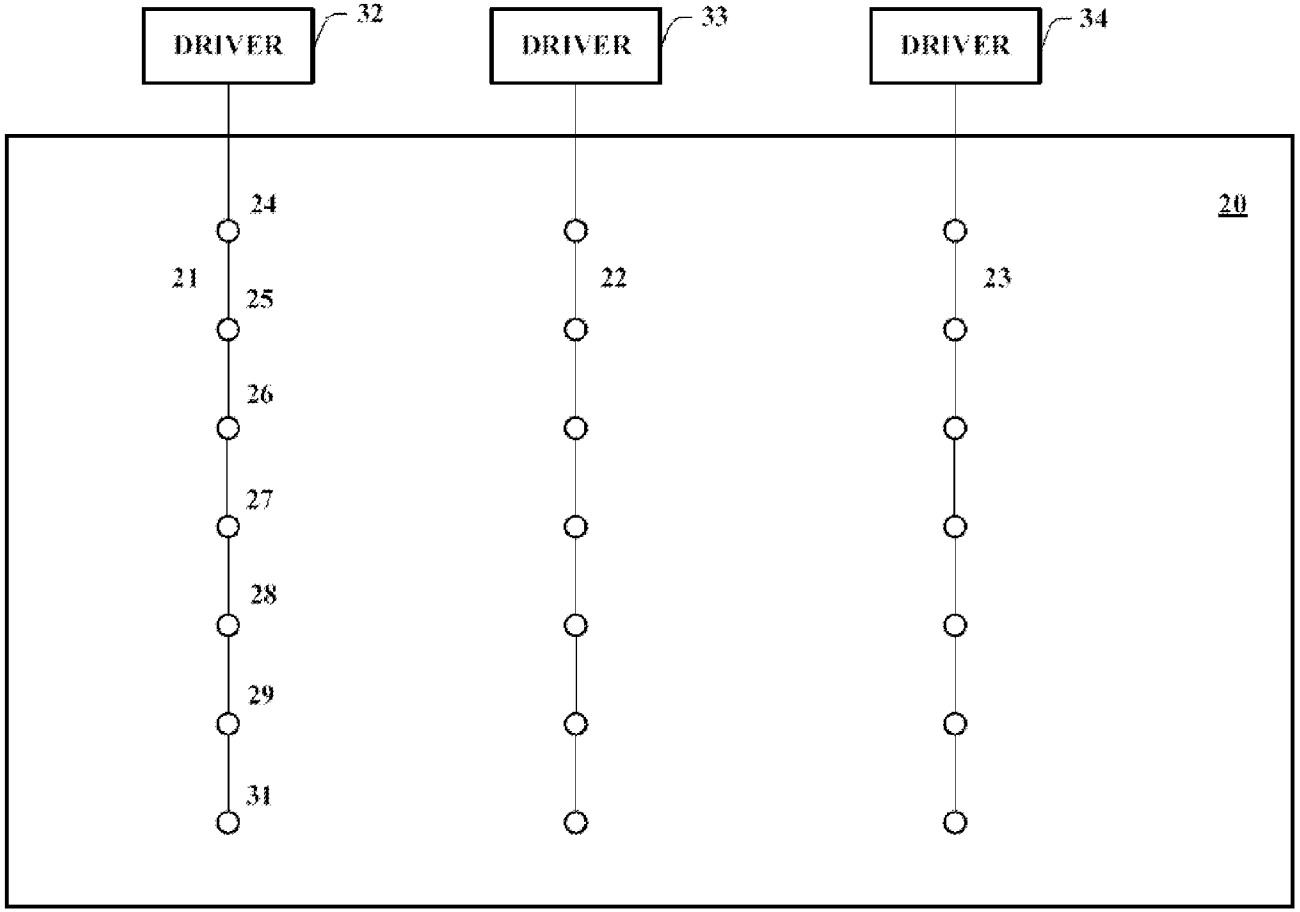
FIG. 2 (Prior Art)
FIG. 2 illustrates an example display implementing light emitting diode strings in accordance with an aspect of the subject specification.
Figure 3:
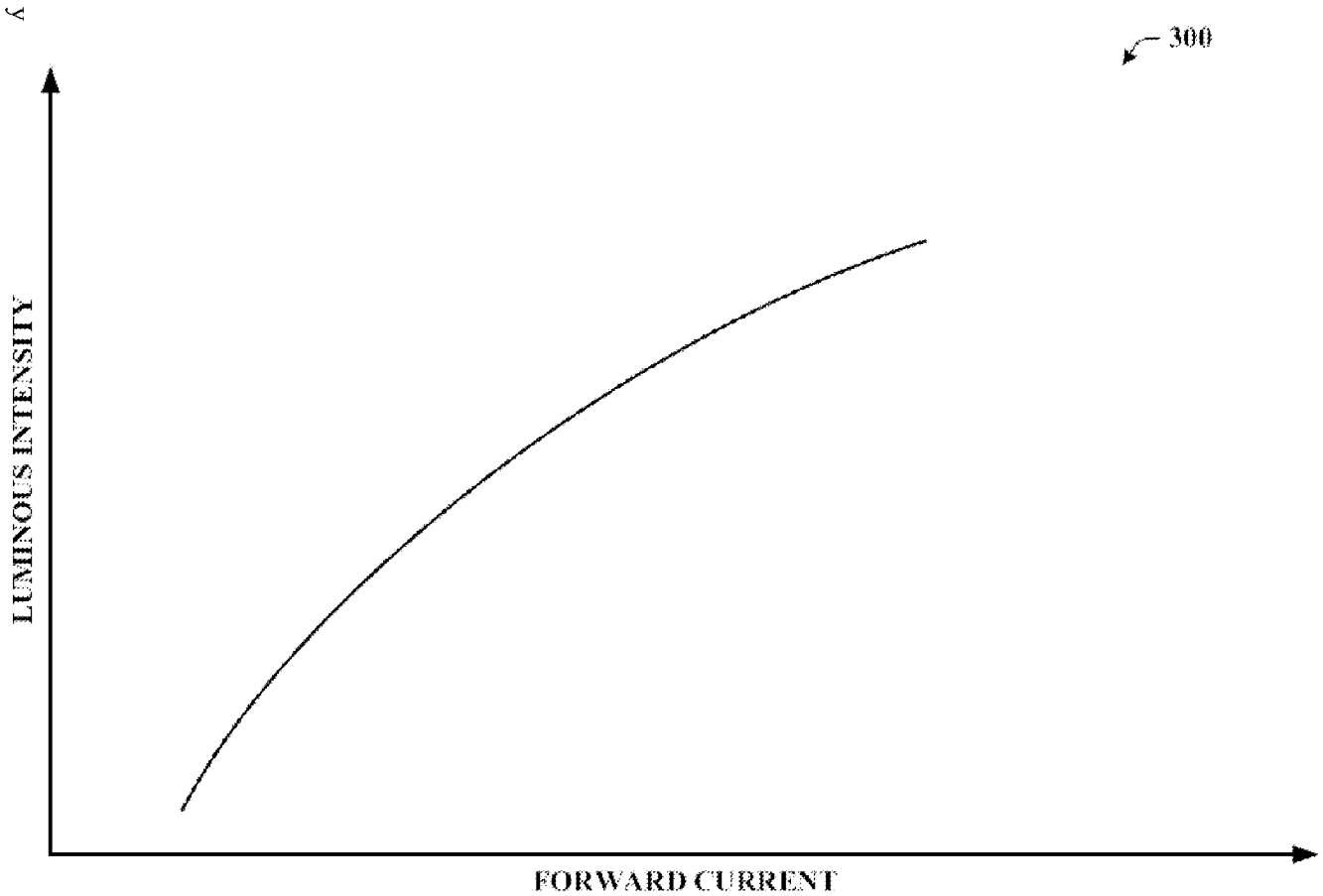
FIG. 3 (Prior Art)
FIG. 3 is an example graph illustrating the relationship between current and luminous intensity in an limiting emitting diode in accordance with an aspect of the subject specification.

Turning now to FIG. 14, an example methodology is shown in accordance with an aspect of the subject innovation. At 1402, a set of characteristics can be determined for one or more light emitting diodes comprising one or more light emitting diode strings (see FIG. 1). The characteristics can be any of a plurality of measurable parameters, including but not limited to, an ambient temperature, a luminous intensity, or a wavelength of light emitted by at least one of the light emitting diodes. As discussed previously, the characteristics can be determined via a set of detectors associated with one or more programmable controllers. Additionally or alternatively, the programmable controller and/or detector can be included in, contained in, or otherwise integrated with a power supply.

At 1404, a control signal can be generated. The control signal can indicate to one or more receiving devices, such as a power supply, a desired value for a drive voltage. At 1406, power factor correction can be performed on an input ac voltage by the power supply. As discussed previously, power factor correction can be used to align voltage and current waveforms in order to attain optimal efficiency. At 1408, the desired drive voltage can be produced based at least in part on the control signal, and a value of a programmable variable resistor located in an input current and voltage control loop. The value of the programmable variable resistor can be controlled via a state machine, wherein the state machine controls the programmable variable resistor based at least in part on at least one of a zero crossing signal, a sample of line voltage Vsine, a discrete error voltage, a limit triode region signal, or an input voltage feedforward correction value. As discussed previously, the zero crossing signal can be determined via a low frequency zero crossing detector included in the power supply. Similarly, the limit triode region signal can be determined via a triode region detector included the power supply.

As used herein, the term "relative to" means that a value A established relative to a value B signifies that A is a function of the value B. The functional relationship between A and B can be established mathematically or by reference to a theoretical or empirical relationship. As used herein, coupled means directly or indirectly connected in series by wires, traces or other connecting elements. Coupled elements may receive signals from each other.

The various illustrative logics, logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. Additionally, at least one processor may comprise one or more modules operable to perform one or more of the steps and/or actions described above.

Further, the steps and/or actions of a method or algorithm described in connection with the aspects disclosed herein may be embodied directly in hardware, in a software module executed by a processor, or in a combination of the two. A software module may reside in RAM memory, flash memory, ROM memory, EPROM memory, EEPROM memory, registers, a hard disk, a removable disk, a CD-ROM, or any other form of storage medium known in the art. An exemplary storage medium may be coupled to the processor, such that the processor can read information from, and write information to, the storage medium. In the alternative, the storage medium may be integral to the processor. Further, in some aspects, the processor and the storage medium may reside in an ASIC. Additionally, the ASIC may reside in a user terminal. In the alternative, the processor and the storage medium may reside as discrete components in a user terminal. Additionally, in some aspects, the steps and/or actions of a method or algorithm may reside as one or any combination or set of codes and/or instructions on a machine readable medium and/or computer readable medium, which may be incorporated into a computer program product.

In one or more aspects, the functions described may be implemented in hardware, software, firmware, or any combination thereof. If implemented in software, the functions may be stored or transmitted as one or more instructions or code on a computer-readable medium. Computer-readable media includes both computer storage media and communication media including any medium that facilitates transfer of a computer program from one place to another. A storage medium may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection may be termed a computer-readable medium. For example, if software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs usually reproduce data optically with lasers. Combinations of the above should also be included within the scope of computer-readable media.

While the foregoing disclosure discusses illustrative aspects and/or embodiments, it should be noted that various changes and modifications could be made herein without departing from the scope of the described aspects and/or embodiments as defined by the appended claims. Furthermore, although elements of the described aspects and/or embodiments may be described or claimed in the singular, the plural is contemplated unless limitation to the singular is explicitly stated. Additionally, all or a portion of any aspect and/or embodiment may be utilized with all or a portion of any other aspect and/or embodiment, unless stated otherwise.

What is claimed is:

1. A circuit for controlling a set of light emitting diode strings, comprising:

a programmable controller having one or more associated detectors, the programmable controller obtains data related to one or more measurable parameters for the set of light emitting diode strings via the associated detectors, determines a drive value based at least in part on the measurable parameters, and generates a control signal based on the drive value;

a power supply system, having power factor correction capability, obtains the control signal as a first input, and an ac waveform voltage as a second input, and generates a drive voltage based at least in part on at least one of the control signal or the ac waveform voltage; and a programmable variable resistor included in the power supply for setting a set of operating conditions for an input current and voltage control loop that facilitate the power supply in generating the drive voltage;

wherein the one or more associated detectors includes at least a first triode region detector coupled to at least a first light emitting diode in the set of light emitting diode strings, the first triode region detector determines a limit triode region for the first light emitting diode; and wherein the programmable controller determines the drive value based at least in part on the limit triode region.

2. The circuit of claim 1, wherein the programmable variable resistor is controlled via a state machine.

3. The circuit of claim 2, wherein the state machine controls the programmable variable resistor based at least in part on at least one of the following inputs: a zero crossing signal, an input line voltage value, a discrete error voltage, the limit triode region, or an input voltage feedforward correction value.

4. The circuit of claim 3, wherein the zero crossing signals are determined via a zero crossing detector included in the power supply.

5. The circuit of claim 1, wherein the one or more associated detectors includes a second triode region detector coupled to at least a second light emitting diode in the set of light emitting diode strings, the second triode region detector determines a second upper limit triode region for the second light emitting diode;

wherein the limit triode region is a first upper limit triode region; and wherein the programmable controller determines the drive value based at least in part on the higher value of the first upper limit triode region and the second upper limit triode region.

6. The circuit of claim 1, wherein the measurable parameters include at least one of an ambient temperature of at least one of the light emitting diodes in the light emitting diode strings, a luminous intensity of at least one of the light emitting diodes in the light emitting diode strings, or a wavelength of light emitted by at least one of the light emitting diodes in the light emitting diode strings.

7. The circuit of claim 1, wherein the programmable controller includes at least one of a digital-to-analog converter, a state machine, digital processing circuitry, or analog processing circuitry.

8. The circuit of claim 7, wherein the state machine included in the programmable controller is also the state machine included in the power supply.

9. The circuit of claim 1, wherein the circuit is implemented in at least one of a liquid crystal display, a light emitting diode lighting system, or light emitting diode related driving system.

10. A method for controlling a set of light emitting diode strings, comprising:

determining at least one characteristic for at least a first light emitting diode included in the light emitting diode strings;

generating a control signal for a drive voltage for at least one of the light emitting diode strings based at least in part on the characteristics;

performing a power factor correction related to ac current and ac voltage waveforms inputs for a power supply;

producing the drive voltage based at least in part on the control signal, and a value of a programmable variable resistor located in an input current and voltage control loop; and wherein determining at least one of the characteristics includes determining, using a first triode region detector, a first limit triode region for the first light emitting diode.

11. The method of claim 10, further comprising controlling the programmable variable resistor via a state machine.

12. The method of claim 11, wherein the state machine controls the programmable variable resistor based at least in part on at least one of a zero crossing signal, an input line voltage value, a discrete error voltage, the limit triode region signal, or an input voltage feedforward correction value.

13. The method of claim 12, further comprising determining the zero crossing signals via a zero crossing detector included in a power supply.

14. The method of claim 12, wherein the characteristics include at least one of an ambient temperature of at least one of the light emitting diodes in the light emitting diode strings, a luminous intensity of at least one of the light emitting diodes in the light emitting diode strings, or a wavelength of light emitted by at least one of the light emitting diodes in the light emitting diode strings.

15. The method of claim 14, further comprising determining the characteristics via a detector included in a programmable controller.

16. The method of claim 15, wherein the programmable controller includes at least one of a digital-to-analog converter, a state machine, digital processing circuitry, or analog processing circuitry.

17. The method of claim 16, wherein the programmable controller and power supply share one or more components.

18. The method of claim 17, wherein the components include the state machine.

19. The method of claim 11, further comprising determining a second limit triode region for a second light emitting diode in the light emitting diode strings via a second triode region detector included in a power supply;

wherein the first limit triode region is a first upper limit triode region; and wherein generating the control signal is based at least in part on a higher drive voltage.

20. A system facilitating control of a set of light emitting diode strings, comprising:

a programmable controller associated with a set of detectors that measures data including at least a limit triode region obtained via a triode region detector of at least one of the light emitting diodes in the light emitting diode strings, the controller determines a drive value based at least in part on the data, and generates a control signal based on the drive value;

a power supply having power factor correction capability that obtains the control signal as a first input, and an ac waveform voltage as a second input, and generates a drive voltage based at least in part on the ac voltage; and a programmable variable resistor included in the power supply that sets a set of input current and voltage control loop operating conditions that facilitate the power supply in generating the drive voltage, wherein a state machine controls the programmable variable resistor based at least in part on at least one of the following inputs: a zero crossing signal generated via a zero crossing detector, an input line voltage value obtained via an input voltage controlled input current loop, a discrete error voltage obtained via an operational amplifier, the limit triode region, or an input voltage feedforward correction signal obtained via an input voltage feed forward correction loop.

* * * * *

UNITED STATES PATENT AND TRADEMARK OFFICE

CERTIFICATE OF CORRECTION

PATENT NO. : 8,441,199 B2
APPLICATION NO. : 12/649057
DATED : May 14, 2013
INVENTOR(S) : Hendrik Santo et al.

It is certified that error appears in the above-identified patent and that said Letters Patent is hereby corrected as shown below:

In the Drawings:

Sheet 10 of 14 (Reference Numeral 1024) (Fig. 10), Line 2, delete "MULTIPLEXOR" and insert --MULTIPLEXER--, therefor.

Sheet 11 of 14 (Reference Numeral 912) (Fig. 11), Line 2, delete "912" and insert --1116--, therefor.

In the Specifications:

Column 7, Line 18, delete "and or" and insert --and/or--, therefor.

In the Claims:

Column 16, Line 4-5, In Claim 12, delete "region signal," and insert --region,--, therefor.

Signed and Sealed this
Third Day of September, 2013

Teresa Stanek Rea
*Acting Director of the United States Patent and Trademark Office*